US005988414A

United States Patent [19]

Schwarz et al.

[11] Patent Number: 5,988,414

[45] **Date of Patent: *Nov. 23, 1999**

[54] LID FOR CONTAINERS, HOUSINGS, BOTTLES OR SIMILAR STRUCTURES

[76] Inventors: Robert Schwarz, Rosskopfstr. 18, D-82031 Grünwald; Thorsten Wiemer, Brunhuberstr. 96, D83512 Wasserburg, both of Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/636,119

[22] Filed: Apr. 23, 1996

[30] Foreign Application Priority Data

Jul. 19, 1995 [DE] Germany ..... 295 11 683 U
Apr. 1, 1996 [EP] European Pat. Off. ..... 96/05220

[51] Int. Cl.[6] ..... B65D 53/00

[52] U.S. Cl. ..... 215/261; 215/308; 220/371; 220/372; 220/373

[58] Field of Search ..... 215/261, 308; 220/371, 372, 373

[56] References Cited

U.S. PATENT DOCUMENTS 3,045,854 7/1962 Patton .
3,448,882 6/1969 Roy .
3,637,101 1/1972 Risch et al. .
3,717,276 2/1973 Luczak et al. .
3,951,293 4/1976 Schulz .
4,121,728 10/1978 Tagalakis et al. .
4,187,390 2/1980 Gore .
4,271,973 6/1981 Quagliaro et al. ..... 215/308
4,765,499 8/1988 Von Reis et al. .
4,789,074 12/1988 Han .
4,790,445 12/1988 Shibata .
4,793,509 12/1988 Coleman ..... 220/207
4,863,051 9/1989 Eibner et al. ..... 215/261
4,983,434 1/1991 Sassa .
5,000,992 3/1991 Kelch .
5,171,439 12/1992 Vakharia .
5,180,073 1/1993 Fay et al. ..... 215/261
5,395,006 3/1995 Verma ..... 220/371

FOREIGN PATENT DOCUMENTS 1174332 8/1985 U.S.S.R. ..... 214/261

*Primary Examiner*—Stephen K. Cronin
*Attorney, Agent, or Firm*—Carol A. Lewis White

[57] ABSTRACT

A lid is disclosed having a pressure compensation device comprising a gas permeable, liquid impermeable membrane and a surge protection element comprising a gas permeable material which serves to break the surge pressure exerted on the membrane by the container contents. The lid is designed as an injection molded plastic part with the membrane being integrated in an upper cover portion of the lid by injection molding.

22 Claims, 4 Drawing Sheets

LID FOR CONTAINERS, HOUSINGS, BOTTLES OR SIMILAR STRUCTURES

FIELD OF THE INVENTION

The invention relates to a lid for closing containers, housings, bottles or similar structures.

BACKGROUND OF THE INVENTION

In closed containers, a liquid often changes its volume, for example, as a result of temperature fluctuations. As a consequence, a positive or negative pressure is produced in the container, which may produce severe damage or danger, depending on the function of the container. Free air/gas volume in the container may also fluctuate. Additional problems are created if the liquids themselves de-gas.

Measuring devices, for example, are filled only with 90 to 95% of liquid, such as glycerole silicone oil. As temperature changes the volume of the liquid, the system is damped as the liquid expands into the remaining space. The expansion of the liquid causes gas to exert pressure on the container wall or devices within the container. As a result, delicate measuring devices may provide false or inaccurate measurement results.

To solve this problem, valve systems have been used with limited success in some applications to regulate pressure exchanges. If the valves are continuously open, however, liquid may run out of the housing in certain positions. Such an effect is not desirable in measuring device applications. Positive pressure valves have been used to prevent liquid spillage, but they do not allow for gas admission, which may be required, for example, after a container or housing has cooled down. Bidirectionally acting valves are feasible, but very costly; therefore less effective valves are chosen.

To accomodate volume changes, one or more of the walls of a container or housing may be elastically deformable to adapt to positive and negative pressures within the housing, however, such elastically deformable walls considerably restrict the range of applications of such a container or housing. Accordingly, elastically deformable walls are typically only used in applications where only slight pressure differences are to be expected.

It is known for a closed housing containing a liquid to be provided with at least with one opening, which is covered by a cover consisting of a liquidproof, yet gas permeable material to obtain a pressure equilibrium. A cover of this type may consist of a porous tetrafluoroethylene polymer which works like a valve performing a bidirectional gas exchange. In this way, the housing can be ventilated or deventilated, depending on what is required, without the danger of liquid spillage.

Furthermore, it is known to provide a lid in the form of a screw-on lid having a pressure compensation device with a porous, gas-permeable yet liquidproof membrane and having a surge protection element, which consists of a gas permeable material and is designed such that it breaks the surge pressure exerted by the membrane on the pressure compensation device.

The foregoing are manufactured as separate components which are inserted or installed in the lid after the lid has been produced. This makes production relatively complex so that lids of this type are rather expensive to manufacture.

The foregoing illustrates limitations known to exist in present lid constructions. Thus, it is apparent that it would be advantageous to provide an improved lid directed to overcoming one or more of the limitations set forth above.

Accordingly, a suitable alternative is provided including features more fully disclosed hereinafter.

SUMMARY OF THE INVENTION

The present invention advances the art of lid construction, and the techniques for creating such lids, beyond that which is known to date. In one aspect of the present invention, a lid is equipped with a pressure compensation device comprising a gas permeable, liquid impermeable membrane and a surge protection element comprising a gas permeable material which serves to break the surge pressure exerted on the membrane by the container contents. The lid is designed as an injection molded plastic part with the membrane being integrated in the upper cover part of the lid by injection molding.

Accordingly, it is a purpose of the present invention to provide a simple lid having a low production cost.

It is another purpose of the present invention to provide such a lid with a pressure compensation device manufactured completely in the course of a single injection molding process to reduce complexity and cost of manufacturing.

BRIEF DESCRIPTION OF THE DRAWINGS

The foregoing summary, as well as the following detailed description of a preferred embodiment of the invention, will be better understood when read in conjunction with the appended drawings. For purposes of illustrating the invention, there is shown in the drawings an embodiment which is presently preferred. It should be understood, however, that the invention is not limited to the precise arrangement and instrumentality shown. In the drawings.

DETAILED DESCRIPTION OF THE INVENTION

Figure 1:
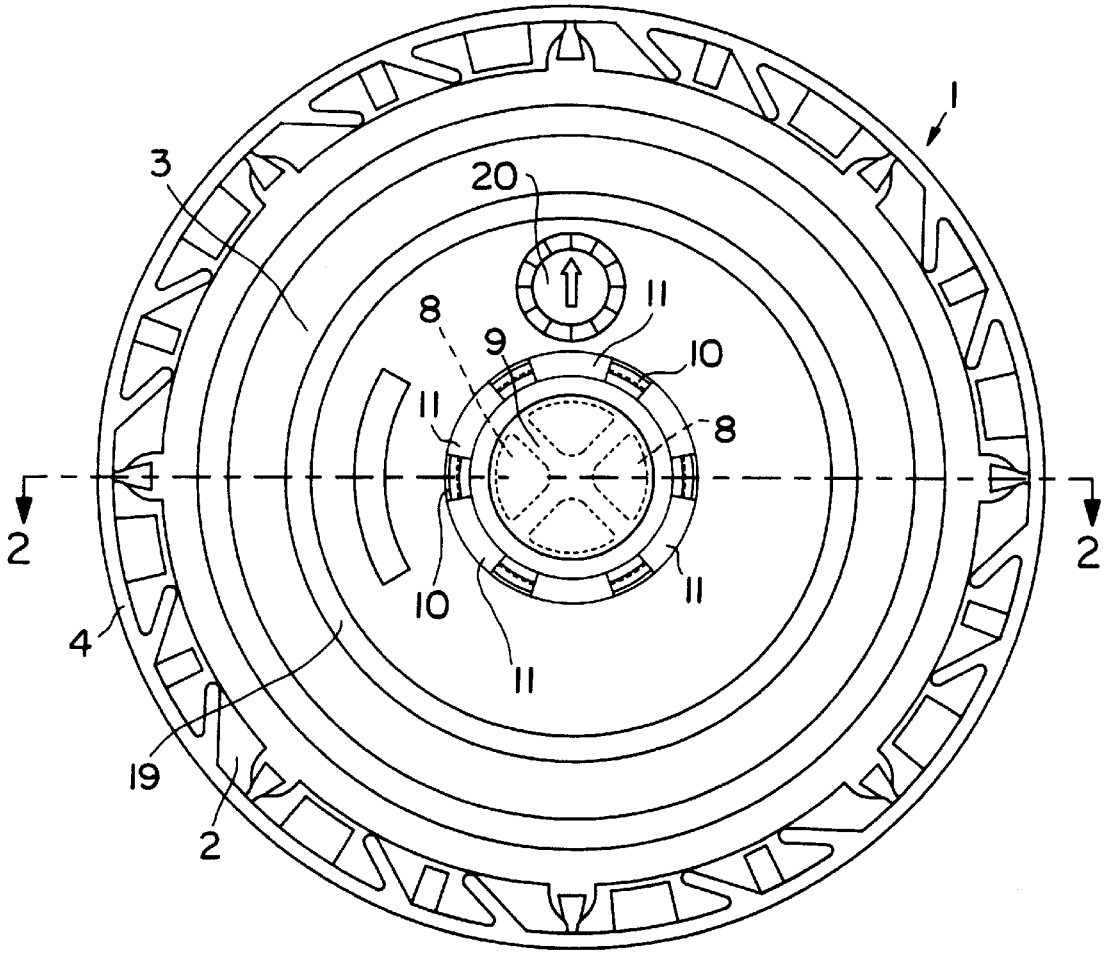
FIG. 1 is a top view of the present invention.
Figure 2:
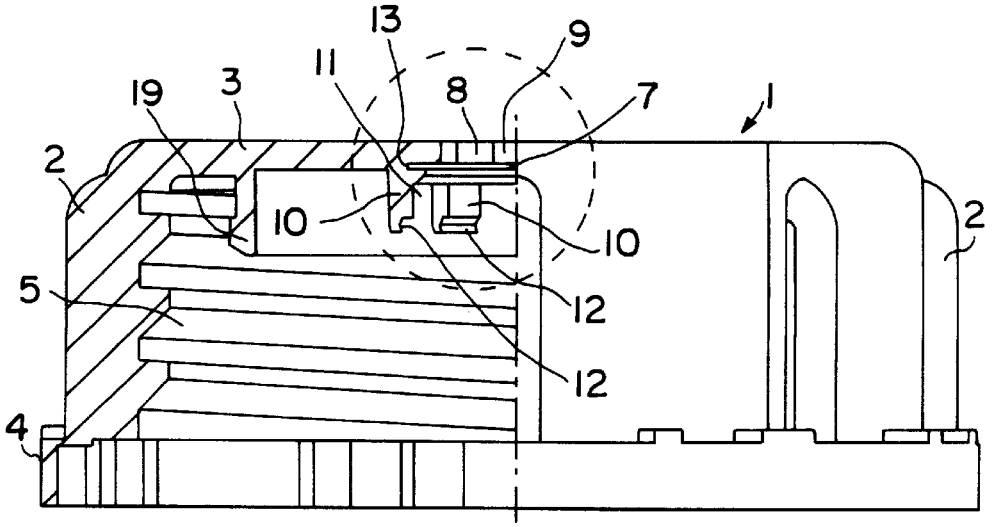
FIG. 2 is a partial sectional view taken along line A–B according to FIG. 1.
Figure 3:
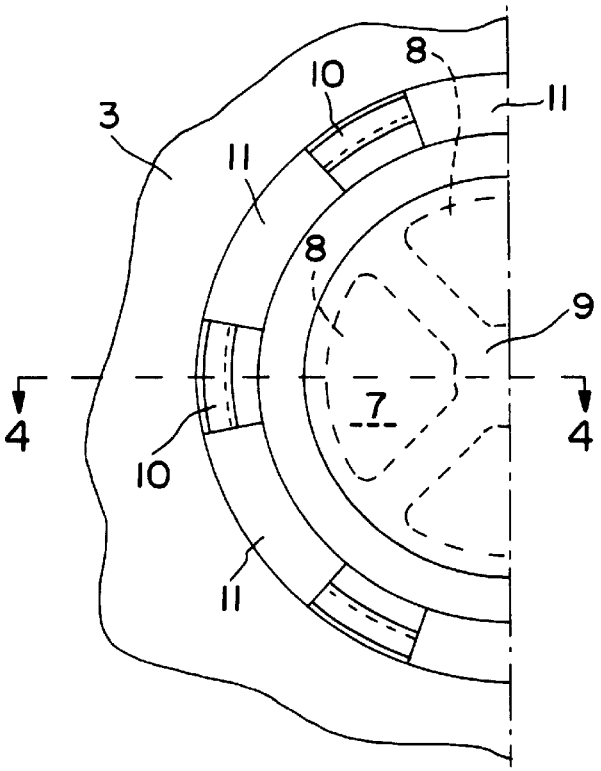
FIG. 3 is a partial view of a cover part of a lid according to FIG. 1.

Referring now to the drawings, wherein similar reference characters designate corresponding parts throughout the several views, the lid of the present invention is generally illustrated at 1 in FIGS. 1 and 2. The lid includes a pressure compensation device comprising a membrane and a surge element.

FIGS. 1–5 refer to one embodiment of a lid 1 for a container (not shown) which can be filled with a liquid or a solid in the form of particles. In FIG. 2, the lid 1 is designed as a screw-on lid which comprises a wall 2, a cover 3, a lower lid edge 4 and an inner screw-on thread 5. The lid 1 can be screwed onto a matching opening of the container which is provided with an outer thread.

The container contents may be liquids with a very low surface tension, or liquids with inorganic/organic surfactants, or detergents, such as chlorine bleach for example, or any other material which is preferably stored in a ventilated structure.

The lid 1 is designed as a plastic injection molded part. A pressure compensation device is injection molded into an upper portion of the cover 3 of the lid 1 during the injection molding process.

Figure 4:
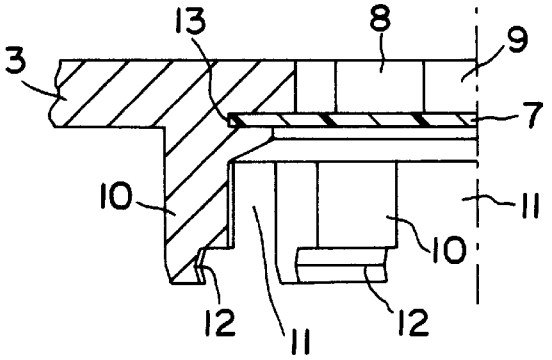
FIG. 4 is a partial sectional view along line C–D according to FIG. 3 (corresponding to the area enclosed by a circle in FIG. 2)
Figure 5:
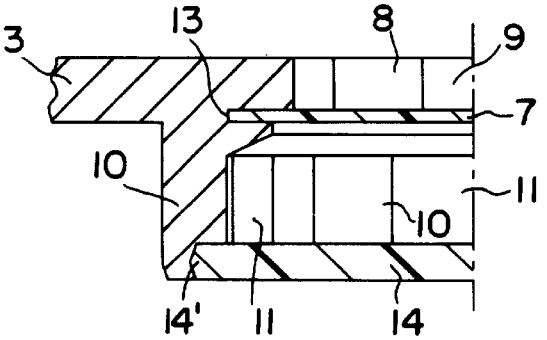
FIG. 5 is a partial sectional view according to FIG. 4 with a surge protection element.

As can be seen particularly well in FIGS. 2, 4 and 5, a gas permeable, liquid impermeable membrane 7 is injection molded into the upper portion of the cover 3 during the injection molding process. Seat 13 is a seat for the membrane 7, or for its edge.

The membrane 7 may be even, flat, curved or dome shaped, depending on the shape of the upper cover part of the lid, which may be designed as a screw-on lid or a snap-on lid.

The pressure compensation device may comprise one or several membranes. In a preferred embodiment, the membrane 7 consists of a material which is selected from a group of the following sintered and non-sintered materials: polypropylene, polyester, polyamide, polyether, polytetrafluoroethylene (PTFE), polysulphone, ethylene tetrafluoroethylene copolymer fluorinated ethylene propylene (FEP) and tetrafluoroethylene/perfluoro(propylvinyl)ether-copolymer (PFA). The membrane material may depend on the material contained within the container or housing. In certain applications, the membrane 7 is preferably formed of expanded microporous polytetrafluoroethylene (PTFE). Furthermore, it may be particularly advantageous if at least one membrane 7 is filled or coated with an adsorbent or a catalyst. The thickness of the membrane 7 generally ranges between 1 and 2000 micrometers. A preferable thickness is from about 1 to about 100 micrometers.

In an alternate embodiment of the present invention, an oleophobic pressure compensation membrane may be used. Such an oleophobic membrane may have an oil repellency rate of≧4, preferably an oil repellency rate of≧8, according to AATCC test method 118–1989 ASTM.

A practicable method for determining the oil repellency rate of oleophobic porous bodies is described in connection with the term "oil repellency rate" pursuant to AATCC Test Method 118–1989 ASTM Handbook of Fiber Science and Technology; Volume II Chemical Processing of Fibers and Fabrics Functional Finishes. Part B.

| Test devices: Test liquids with surface tension at 25° C.: | |
|---|---|
| #1 Nujol | 31.2 dyn/cm |
| #2 65:35 Nujol:n-hexadecane (vol % ) | 28.7 dyn/cm |
| #3 n-hexadecane | 27.1 dyn/cm |
| #4 n-tetradecane | 26.1 dyn/cm |
| #5 n-dodecane | 25.1 dyn/cm |
| #6 n-decane | 23.5 dyn/cm |
| #7 n-octane | 21.3 dyn/cm |
| #8 n-heptane | 19.8 dyn/cm |
| #9 n-hexane | 18.4 dyn/cm |

Test specimens: porous bodies, membranes, laminates, hoses.

Test Method

Drops of the above-mentioned test liquids which have different surface tensions are dripped onto the test specimens and observed.

If the surface energy of the test specimen lies below the surface energy of the test liquid, the drop cannot enter the porous structure of the specimen.

Physical background for wetting

The contact angle θ of the liquid drop on the surface of the test body is a measure of the degree by which a liquid wets a body.

If the contact angle is 0°, the test specimen is completely wetted by the liquid, in other words, the liquid is fully absorbed by the test specimen. When a porous membrane has been wetted, the wetted spot becomes transparent or dark. Contact angle θ is measured as follows:

$\cos\theta=(\sigma_{sv}-\sigma_{sl})/\sigma_{lv}$ wherein:

$\sigma_{sv}$=surface tension solid - vapour;

$\sigma_{sl}$=surface tension solid-liquid; and $\sigma_{lv}$=surface tension liquid - vapour.

The drop size should be 4–6 mm in diameter. The test should be effected at room temperature, 21° C.±1° C.

The membrane 7 may also be laminated onto at least one layer of a carrier material. The membrane 7 may, in particular, be laminated to at least one layer containing an adsorbing material or a catalyst. The carrier material for lamination preferably consists of a non-woven, a woven, a knit, a plate with holes or a grid. The carrier material for this lamination may be selected from a group consisting of the following sintered or non-sintered materials: polypropylene, polyester, polyamide, polyether, polytetrafluoroethylene (PTFE), polysulphone, ethylene-tetrafluoroethylene-copolymer, fluorinated ethylene propylene (FEP), tetrafluoroethylene/perfluoro(propylvinyl)ether copolymer (PFA), uncoated metal and coated metal.

Depending on the specific application, it may be advantageous to apply the carrier material layer onto one or two sides of the membrane or, alternatively, to apply the membrane onto one or two sides of the carrier material layer.

As best seen by reference to FIG. 5, in a concentric arrangement relative to a circular membrane 7, a plurality of ribs 10 are injection molded and project from the cover 3 downward toward the interior of the lid. The plurality of ribs 10 are preferably located at equal distances from each other. Interstices 11 are formed between every two adjacent ribs 10. The plurality of ribs 10 are provided with recesses 12 at their lower ends, as shown in FIG. 4. Recesses 12 of the ribs 10 form snap-in seats 14' for snapping in a basically circular surge protection element 14, as can be seen in FIG. 5.

Both the membrane 7 of the pressure compensation device and the surge protection element 14 are of a planar or flat shape. The surge element 14 is arranged below the membrane 7. Furthermore, the membrane 7 is arranged underneath a lid top 9 which is provided substantially in the center of the cover 3. The lid top 9 preferably has the shape of a cross and is provided with a number of openings 8 which allow gas to pass through if a pressure equilibrium needs to be established between the interior of the container and the surrounding atmosphere. The lid top 9 also offers mechanical protection for the membrane 7.

The surge protection element 14 is arranged underneath the membrane 7, seen in the direction towards the interior of the container, is designed as a round disk (corresponding to the membrane 7) and ensures that the surge pressure exerted by the liquid on the container does not damage the porous membrane 7. The openings in this surge protection element 14 preferably have an opening diameter or a mesh size in a range between 5 and 2000 microns in the liquid passage direction from inside out. The surge protection element 14 is gas permeable to allow for the required pressure compensation and is designed such that liquid or solid particles contained in the container can flow off or away from the surge protection element. If liquid was trapped, the surge protection element would not be permeable to gas.

According to one embodiment of the present invention, the surge protection element 14 may be arranged in the area of the upper cover part and below the membrane 7. In a preferred construction, the surge protection element is detachably mounted in the area of the cover part of the lid below the membrane of the pressure compensation device. In particular, the surge protection element is snapped to the plurality of ribs 10 projecting downward toward the interior of the lid. The surge protection element 14 may be suitably dimensioned depending on how the cover part of the lid is designed.

In another embodiment of the present invention, the membrane of the pressure compensation device is designed together with the surge protection element as a single, combined integral component. The integral component may then be incorporated into the lid in the area of its cover, or injection molded to or in the cover. The carrier material layer onto which the membrane 7 may be laminated may be designed as a surge protection element itself.

As can be seen in FIGS. 1 and 2, the lid 1 is provided with a fixation ring 19 which is located in the area of the cover 3 which faces the interior of the container. The fixation ring 19 is located at a predetermined distance from the inner screw-on thread 5 and surrounds the rib arrangement 10 at a predetermined distance. This fixation ring 19 serves to hold stationary a lid sealant (not shown) which ensures that the connection between the container and the screwed on lid is well sealed.

FIG. 1 also shows that on the upper surface of the cover 3 there is a date clock 20 which shows the date when the lid was produced.

Figure 6:
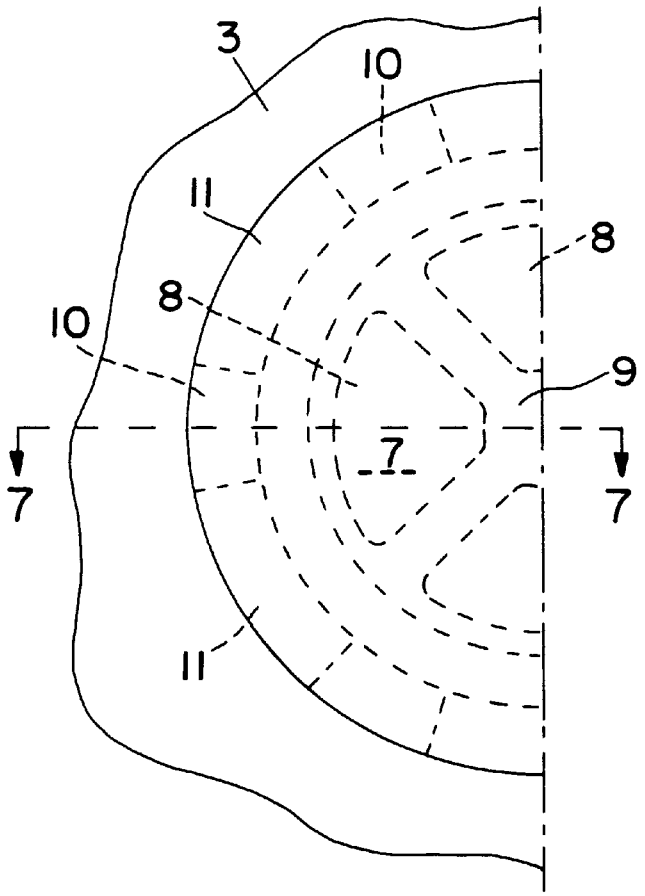
FIG. 6 is a top view of an alternative embodiment of the present invention.
Figure 7:
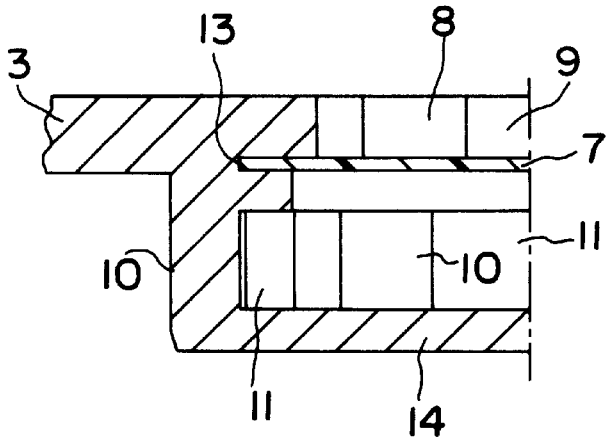
FIG. 7 is a sectional view along line E–F according to FIG. 6.

In FIGS. 1–5, the surge protection element 14 is detachably snapped into the snap-in seat 14'. In FIGS. 6 and 7, the lid 1 is formed such that the surge protection element is formed during the injection molding process as an integral part of the lid with the membrane 7 being between the lid top 9 and the surge protection element 14. The cover 3 is designed as a single piece with the surge protection element 14 and the ribs 10. In this embodiment of the present invention, there are no recesses 12 of the ribs 10.

Figure 8:
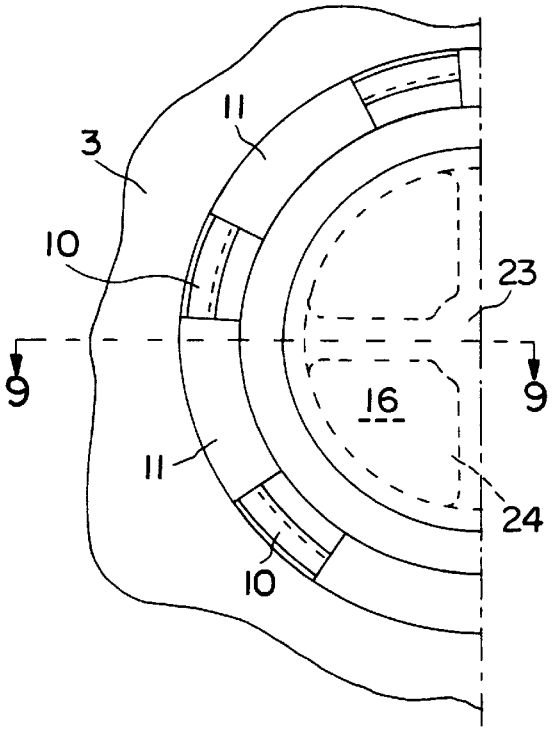
FIG. 8 is another detailed view of the present invention.
Figure 9:
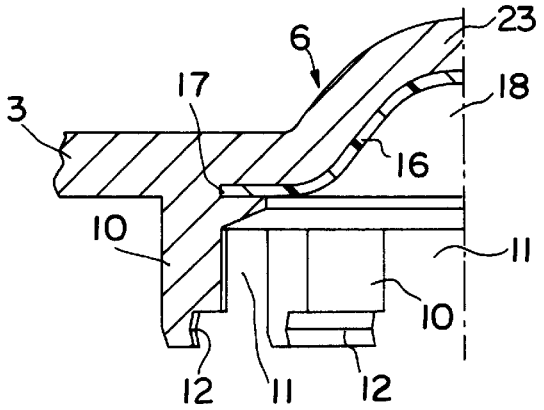
FIG. 9 is a sectional view along line G–H according to FIG. 8.
Figure 10:
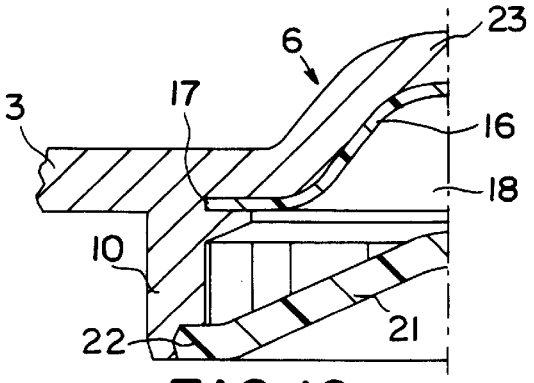
FIG. 10 is a sectional view according to FIG. 9 with a surge element.

The embodiment of a lid 6 designed as a plastic injection molded part, as shown in FIGS. 8–10, is provided with a convexly curved cover 23 in the center area of the cover 3 above the corresponding pressure compensation device with a membrane 16. The convexly curved cover 23 is in the shape of a cross and defines a number of openings 24 for the passage of gas. The membrane 16 consists of a liquid impermeable, gas permeable material, as explained hereinabove, and is arranged directly below the cover 23 curving correspondingly to the dome shape of the cover 23. The membrane 16 is integrated into the lid 6 and injection molded into the upper cover part 3 with a seat 17.

A surge protection element 21 is installed in the area of the cover 3 underneath the membrane 16, preferably being captured by ribs 10. The snap-in seat 22 of FIG. 10 captures the surge protection element 21. As illustrated in FIG. 10, the surge protection element 21 is curved to mirror the shape of the membrane 16 and the lid 23. Through an interstice 18 which is curved correspondingly and which is provided between the surge protection element 21 and the membrane 16, the gas or air flows upwards during a pressure compensation process.

Apart from the curved shape of the membrane 16 and the surge protection element 21, the lid shown in FIGS. 8–10 is as shown in FIGS. 1–5. The materials used for the membrane 16 and the surge protection element 21 correspond to those described further above for the other embodiments.

Although a few exemplary embodiments of the present invention have been described in detail above, those skilled in the art readily appreciate that many modifications are possible without materially departing from the novel teachings and advantages which are described herein. Accordingly, all such modifications are intended to be included within the scope of the present invention, as defined by the following claims.

We claim:

1. A lid for a container, wherein at least one opening of the container can be reopenably closed using the lid, the lid comprising:

an upper cover part;

a pressure compensation device having at least one liquid impermeable, gas permeable membrane having a first surface and a second surface opposing the first surface; and a surge protection element comprising a gas-permeable material for breaking a container content surge pressure exerted on said membrane;

wherein the membrane of the pressure compensation device is at least partly encased by injection molded material of the lid, said material extending from the first surface of the membrane to the second surface of the membrane thereby integrating the membrane into the lid so that the membrane is not separately detachable therefrom.

2. The lid of claim 1, wherein the membrane of the pressure compensation device is of a flat shape.

3. The lid of claim 1, wherein the membrane of the pressure compensation device is of a curved, dome shape.

4. The lid of claim 1, wherein the membrane consists of a sintered or non-sintered material which is selected from a group consisting of: polypropylene, polyester, polyamide, polyether, polytetrafluoroethylene (PTFE), polysulphone, ethylene-tetrafluoroethyle-copolymer, fluorinated ethylenepropylene (FEP) and tetrafluoroethylene/perfluoro (propylvinyl)ether-copolymer (PFA).

5. The lid of claim 1, wherein the membrane comprises expanded microporous polytetrafluoroethylene (PTFE).

6. The lid of claim 1, wherein the membrane has a thickness ranging between 1 and 2000 microns.

7. The lid of claim 1, wherein the membrane has a thickness ranging between 1 and 100 microns.

8. The lid of claim 1, wherein the membrane is filled with an adsorbent.

9. The lid of claim 1, wherein the membrane is filled with a catalyst.

10. The lid of claim 1, wherein said membrane is oleophobic.

11. The lid of claim 1, wherein said membrane has an oil repellency rate of≧4.

12. The lid of claim 1, wherein said membrane has an oil repellency rate of≧8.

13. The lid of claim 1, wherein the membrane of the pressure compensation device is made integral with the surge protection element as a single, combined component which is made integral with the lid.

14. The lid of claim 1, wherein the surge protection element is of a flat shape.

15. The lid of claim 1, wherein the surge protection element is of a curved, dome shape.

16. The lid of claim 1, wherein the membrane is located between the surge protection element and the upper cover part.

17. The lid of claim 16, further comprising at least one locking rib connected to the upper cover part, wherein the surge protection element is detachably mounted to the lid by being captured by the at least one locking rib.

18. The lid of claim 1, wherein the membrane is laminated onto at least one layer comprising a carrier material.

19. A lid of claim 18, wherein the carrier material is the surge protection element.

20. The lid of claim 18, wherein the carrier material is selected from a group consisting of: a non-woven fabric, a woven fabric, a knit fabric, a perforated plate and a grid.

21. The lid of claim 20, wherein the carrier material is a sintered or non-sintered material selected from a group consisting of: polypropylene, polyester, polyamide, polyether, polytetrafluoroethylene (PTFE), polysulphone, ethylene-tetrafluoroethylene copolymer, fluorinated ethylene-propylene (FEP), tetrafluoroethylene/perfluoro (propylvinyl)ether-copolymer (PFA); non-coated metal and coated metal.

22. The lid of claim 20, wherein the carrier material is applied on at least one side of the membrane.

* * * * *